US005336100A

United States Patent [19]

Gabrius et al.

[11] Patent Number: 5,336,100

[45] Date of Patent: Aug. 9, 1994

[54] CONNECTOR FOR TRACK

[75] Inventors: Algimantas J. Gabrius, Carol Stream; Scott L. Roos, Glenview; Thomas J. DeCicco, Arlington Heights, all of Ill.

[73] Assignee: Juno Lighting, Inc., Des Plaines, Ill.

[21] Appl. No.: 116,377

[22] Filed: Sep. 3, 1993

[51] Int. Cl.[5] ..... H01R 25/14; H01R 4/40

[52] U.S. Cl. ..... 439/115; 439/797

[58] Field of Search ..... 439/115, 210, 213, 723, 439/724, 784, 797

[56] References Cited

U.S. PATENT DOCUMENTS

| | | | |
|---|---|---|---|
| 2,997,688 | 8/1961 | Nielsen et al. | 439/797 |
| 3,541,224 | 11/1970 | Joly | 439/213 |
| 3,622,938 | 11/1971 | Ito et al. | 439/115 |
| 3,831,130 | 8/1974 | Valtonen | 439/115 |

FOREIGN PATENT DOCUMENTS

| | | | |
|---|---|---|---|
| 3136661 | 3/1983 | Fed. Rep. of Germany | 439/797 |

*Primary Examiner*—Gary F. Paumen

*Attorney, Agent, or Firm*—Anthony S. Zummer

[57] ABSTRACT

A connector is securely mounted on the end of a low voltage track. The connector is electrically connected to a pair of spaced conductive wires in the tracks. The conductive wires are separated in an insulator body. The insulator body has a pair of opposed inwardly extending edges. The terminal includes a base having a pair of opposed resilient side walls. Each of the side walls defines in part a respective longitudinal receptacle groove. Each receptacle groove is parallel to the other groove. A cantilever tongue is formed integral with the side walls and is substantially parallel to the grooves. The tongue is positioned between the opposed edges of the insulator body. The tongue has opposed portions positioned under the inwardly extending edges of the insulator body. A connector belt is positioned in each of the receptacle grooves. Each connector belt receives a wire from the low voltage track. A fastener is mounted in each of the connector belts for securing a respective wire in its connector belt and provides an electrically conductive connection between the belt and the wire.

15 Claims, 4 Drawing Sheets

CONNECTOR FOR TRACK

BACKGROUND OF THE INVENTION

It is desirable for track lighting to have a low voltage rather than the customary 120 volts which is used in many instances. The low voltage track lighting utilizes a track which is smaller than the track which is used for 120 volt lighting. One of the problems encountered in low voltage track lighting is the connection of one piece of track to another or connecting the end of a track either to a source of electricity or to some other equipment.

In the case of track lighting which uses 120 volts, a small voltage drop does not have a significant effect in the operation of lamps mounted on the tracks. However, when the voltage is low, even a small voltage drop has a substantial effect on lamps energized from the track. Accordingly, it is particularly desirable to provide a connector which may be used as an end feed or a joiner wherein there is very little voltage drop through the connector.

It is a principle object of the present invention to provide a connector which mechanically holds two pieces of track together or a track with an end feed wherein the mechanical connection is secure and there is negligible voltage drop.

SUMMARY OF THE INVENTION

The present invention is directed to a connector for securing two pieces of low voltage track together, or securing an end of a low voltage track to a low voltage end feed. The typical construction of a low voltage track includes an insulator body having a pair of opposed inwardly extending edges. A pair of spaced conductive wires is mounted in the insulator body. The connector includes a base having a pair of opposed resilient side walls. The side walls define in part respective longitudinal receptacle grooves. The receptacle grooves are parallel to each other. A cantilever tongue is integral with and connected to the side walls. The tongue is parallel to the grooves. The tongue is positioned between the opposed edges of the insulator body. The tongue includes opposed portions which are positioned under respective inwardly extending edges of the insulator body. A connector belt is mounted in each of the receptacle grooves and receives a wire from the low voltage track. A fastener is mounted in each of the connector belts for securing the belt to its respective wire and to provide an electrically conductive connection between the wire and the belt.

DETAILED DESCRIPTION OF THE INVENTION

Figure 1:
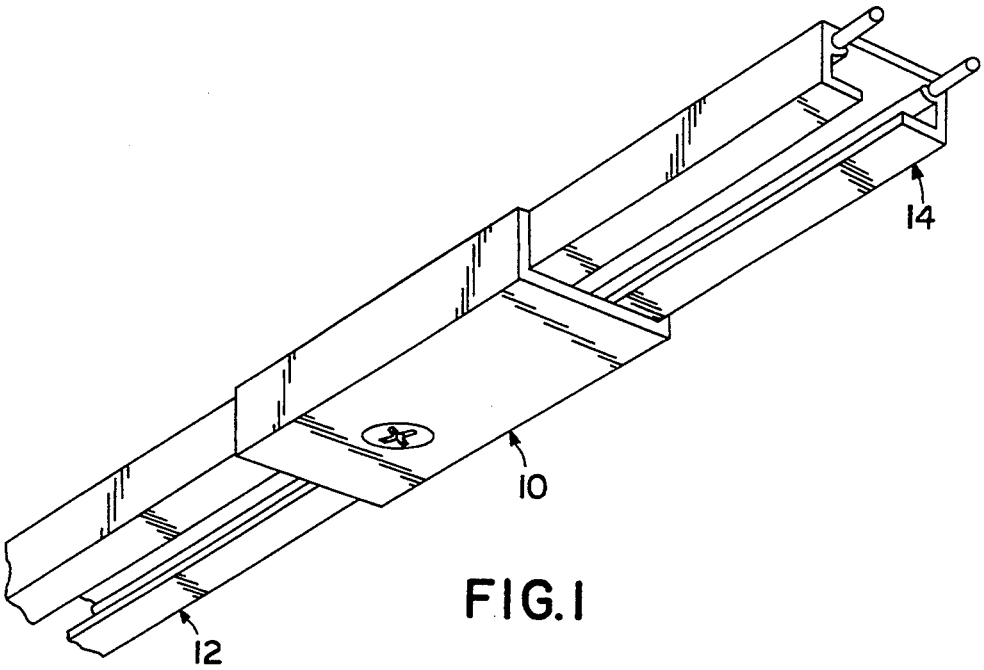
FIG. 1 is a perspective view of a connector embodying the herein disclosed invention connecting a pair of low voltage tracks.
Figure 2:
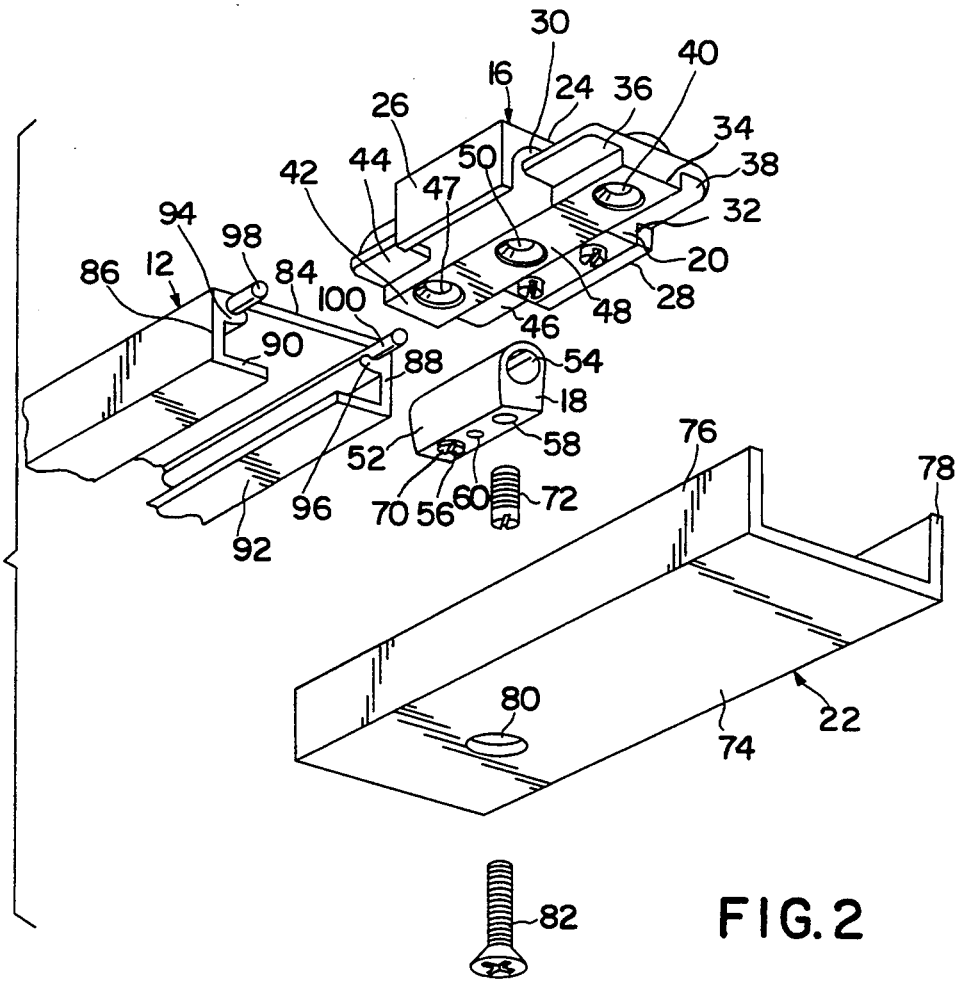
FIG. 2 is an exploded view of the connector of FIG. 1 showing various parts of the connector and an end portion of one of the tracks.
Figure 3:
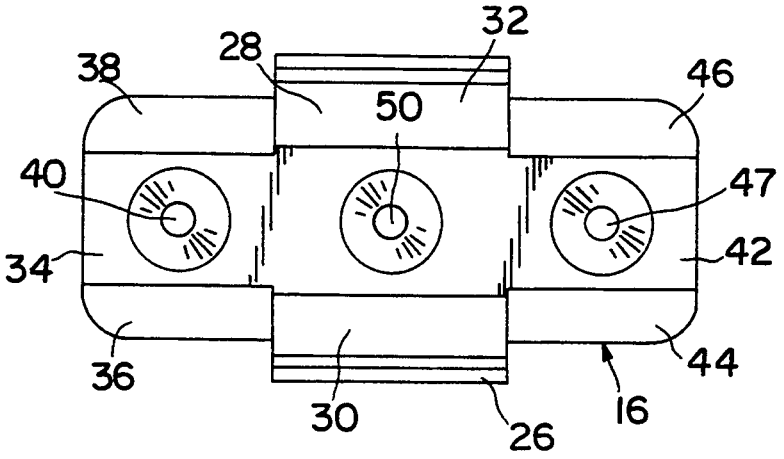
FIG. 3 is a bottom view of a base for the connector.
Figure 4:
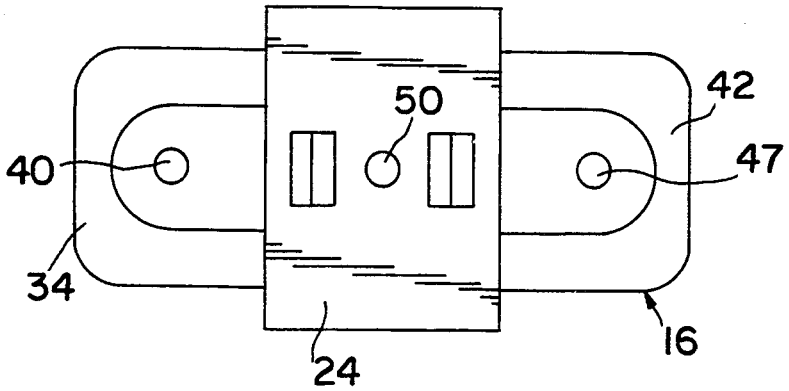
FIG. 4 is a top view of the base for the connector.
Figure 5:
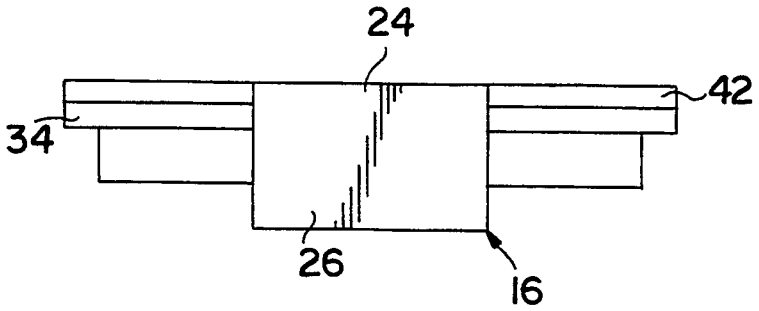
FIG. 5 is a side elevational view of the base for the connector.
Figure 6:
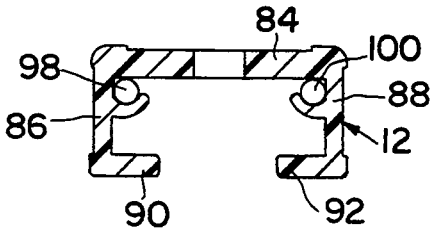
FIG. 6 is a cross sectional view of a low voltage track.

Referring now to the drawings and especially to FIG. 1, a connector for track, generally indicated by numeral 10, is shown connected to a pair of conventional low voltage tracks 12 and 14 which tracks are used for receiving low voltage light fixtures. As may be best seen in FIG. 2, connector 10 generally includes a base 16 with a pair of connector belts 18 and 20 mounted therein and a cover 22 connected to the base.

Base 16 is a plastic insulating material having a main body 24 which has a pair of resilient walls 26 and 28 formed integral therewith. Walls 26 and 28 in part define receptacle grooves 30 and 32, respectively. Grooves 30 and 32 are parallel to each other. A tongue 34 is formed integral with body 24 and is generally parallel to grooves 30 and 32. Tongue 34 includes a pair of recessed portions 36 and 38 and a screw aperture 40.

A second tongue 42 is formed integral with body 24 and is aligned with the first mentioned tongue 34. Second tongue 42 is also parallel to grooves 30 and 32. The second tongue has a pair of recessed portions 44 and 46 and a screw aperture 47. Base 16 includes a ridge 48 which extends along the length of the base through body 24 and terminating in tongues 34 and 42. A cover secure aperture 50 is formed in the body through ridge 48.

Figure 8:
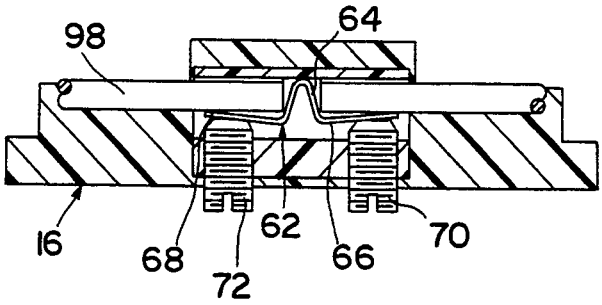
FIG. 8 is a cross sectional view showing a pair of wires connected through a connector belt.
Figure 9:
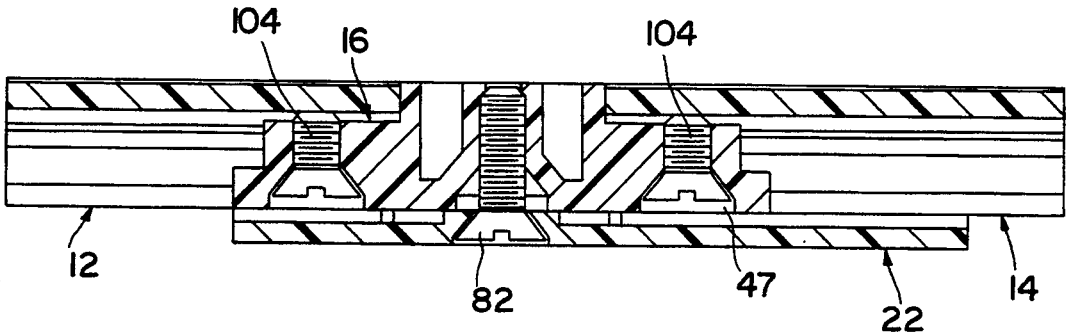
FIG. 9 is a cross sectional side elevational view showing the instant invention mounted on a pair of tracks.
Figure 10:
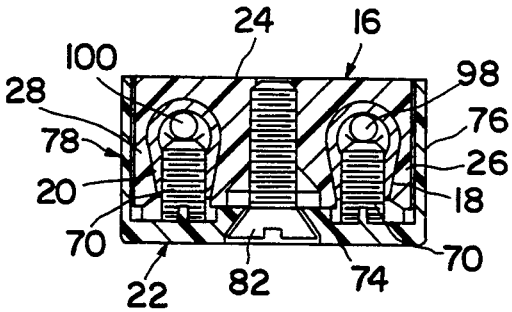
FIG. 10 is a cross sectional view taken through the instant connector showing a wire mounted in each of a pair of connector belts.

Each of the connector belts 18 and 20 has the same construction. Each connector belt, as may be seen in FIGS. 2 and 8, includes a block 52 with a wire aperture 54 extending through the length of the block. A pair of fastener apertures 56 and 58 is formed in the block and open into wire aperture 54. A positioning hole 60 is positioned between the fastener apertures 56 and 58.

A wire guard 62 is mounted in each of the connect belts. Each wire guard 62 includes a generally V-shaped wire stop 64 with a pair of integral wings 66 and 68 extending in opposite directions. A pair of set screws 70 and 72 is threadingly mounted in the apertures 56 and 58, respectively.

Cover 22 includes a lid 74 with a pair of support walls 76 and 78 formed integral with the lid. The lid includes a screw opening 80 through which is mounted a conventional cover screw 82 which is threadingly mounted in aperture 50 to secure the cover to the base.

A conventional low voltage track 12 includes a web 84 with a pair of flanges 86 and 88 formed integral therewith. The flanges 86 and 88 have edges 90 and 92 formed integral therewith respectively. The edges 90 and 92 are opposed inwardly extending edges which receive base 16. Wire ears 94 and 96 are formed integral with flanges 86 and 88 to provide a receptacle for conventional low voltage wires 98 and 100, respectively.

Figure 7A:
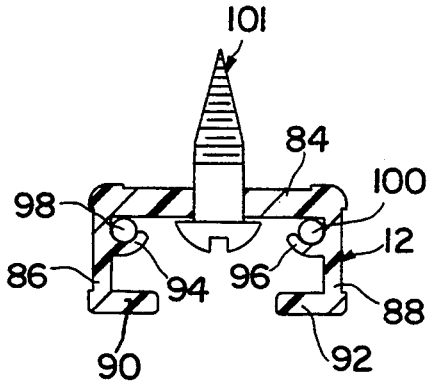
FIG. 7A is a cross sectional view similar to FIG. 6 but showing a screw used for securing a low voltage track to a surface.
Figure 7B:
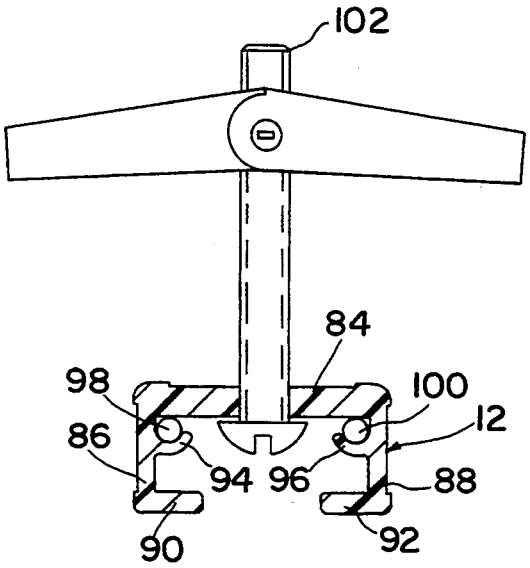
FIG. 7B is a cross sectional view showing the low voltage track with a molly bolt mounted therein for securing the track to a surface.

The construction of track 14 is identical to the construction of track 12 identified below. The tracks are typically mounted on a surface such as a ceiling by conventional fasteners; a screw 101 as shown in FIG. 7A or a molly bolt as shown in FIG. 7B.

In order to connect the low voltage tracks 12 and 14 with a minimum of voltage drop through the connector and provide a secure mechanical connection, the connector is inserted between the ends of the track. A wire from the track is placed in the wire aperture of a connector belt. The wire guard has a wire stop which prevents the wire from entering too far. The wings of the wire guard are positioned in contact with the two wires and set screws 70 and 72 are adjusted to place the wings of the wire guard into good electrical contact with the wires. The wires make electrical contact with the connector belt to provide an additional current path. Thus, there is very little voltage drop between the wires at the connection.

The tongue of base 16 is positioned between edges 90 and 92. The recessed portions 44 and 46 allow the tongue to be positioned in engagement with an interior portion of the edges 90 and 92. A screw 104 is mounted in the screw aperture 47 and is tightened to engage web 84 of the track. Thus, the tongue is held in secure engagement with the edges and the screw provides the additional frictional engagement with the web in order to effect a secure mechanical connection between the connector and the track. The tracks are thus securely mechanically connected to each other and there is an electrical connection between the respective wires of the tracks with a minimum of voltage drop.

Cover 22 is mounted on the base to cover the connector belts. Side walls 76 and 78 engage the resilient side walls 26 and 28, respectively, to hold side walls 26 and 28 against the respective connector belts, thereby further securing the connector belts in the base.

It may be readily appreciated that although the description herein shows a connector connecting two tracks, the instant invention may be used to connect an end of a track to a piece of equipment, such as, a transformer.

A specific disclosure of the instant invention has been shown and described in detail above. It is to be expressly understood that the instant invention is too limited by the appending claims.

We claim:

1. A connector for securely mounting on an end of a low voltage track; said track having an insulator body and a pair of spaced conductive wires, said insulator body having a pair of opposed inwardly extending edges, said connector including: a base having a pair of opposed resilient side walls, each of said side walls defining in part a respective longitudinal receptacle groove, said receptacle grooves being parallel to each other, a cantilever tongue integrally connected to the side walls and being substantially parallel to said grooves, said tongue being positioned between the opposed edges, said tongue having opposed portions positionable under the inwardly extending edges of the insulator body, a connector belt mounted in each of the receptacle grooves for receiving a respective said wire therein from the low voltage track, and a screw fastener mounted in each of the connector belts for securing the connector belt to its respective wire to provide electrically conductive connection therebetween.

2. A connector as defined in claim 1, including: a wire guard mounted in each of the connector belts, each wire guard having a wire stop and a wing integral with the wire stop, each wing positionable between the respective wire and the respective fastener.

3. A connector as defined in claim 1, including: a screw mounted in the tongue holding the tongue in engagement with the inwardly extending edges.

4. A connector as defined in claim 1, including: a cover mounted on said base, said cover having a pair of opposed support walls, said support walls being in engagement with the resilient side walls holding the resilient side walls in place.

5. A connector as defined in claim 1, including: a second cantilever tongue integrally connected to the side walls and substantially aligned with the first mentioned cantilever tongue, said second cantilever tongue extending in the opposite direction to the first mentioned cantilever tongue, said second tongue being positionable between opposed inwardly extending edges of a second low voltage track, said second tongue having opposed portions positionable under inwardly extending edges of a second low voltage track.

6. A connector as defined in claim 1, including: a screw mounted in the tongue engageable with the body for holding the tongue in secure engagement with the inwardly extending edges, and a wire guard mounted in each of the connector belts, each wire guard having a wire stop and a wing positionable between the respective wire and the respective fastener.

7. A connector as defined in claim 1, including: a wire guard mounted in each of the connector belts, each wire guard having a wire stop and a wing positionable between the respective wire and the respective fastener, and a cover mounted on said base, said cover having a pair of integrally connected opposed support walls, said support walls being in engagement with the resilient side walls for holding the resilient side walls in position to retain each of the connector belts mounted in its respective groove.

8. A connector as defined in claim 1, including: a second cantilever tongue integrally connected to the side walls substantially aligned with the first mentioned cantilever tongue and extending in the opposite direction to the first mentioned cantilever tongue, said second tongue being positionable between opposed edges of a second low voltage track, said second tongue having opposed portions positionable under inwardly extending edges of a second low voltage track, and a wire guard mounted in each of the connector belts, each wire guard having a wire stop and a wing positionable between the respective wire and the respective fastener.

9. A connector as defined in claim 1, including: a cover mounted on said base, said cover having a pair of opposed support walls, said support walls being in engagement with respective resilient side walls holding the resilient side walls in position, and a screw mounted in the tongue holding the tongue in secure engagement with the inwardly extending edges.

10. A connector as defined in claim 1, including: a second cantilever tongue integrally connected to the side walls being substantially aligned with the first mentioned cantilever tongue and extending in the opposite direction to the first mentioned cantilever tongue, said second tongue being connectable to a second low voltage track, said second low voltage track having a second pair of inwardly extending edges, said second tongue having opposed portions positionable under the second inwardly extending edges of the second low voltage track, and a screw mounted in each tongue urging each tongue into secure engagement with the respective inwardly extending edges.

11. A connector as defined in claim 1, including: a cover mounted on said base, said cover having a pair of opposed support walls, said support walls in engagement with respective resilient side walls holding the respective resilient side walls in position, and a second cantilever tongue integrally connected to the side walls and being substantially aligned with the first mentioned cantilever tongue, said second cantilever tongue extending in the opposite direction to the first mentioned cantilever tongue, said second tongue being positionable between opposed edges of a second low voltage track, said second tongue having opposed portions positionable under inwardly extending edges of a second low voltage track.

12. A connector as defined in claim 1, including: a wire guard mounted in each of the connector belts, each wire guard having a wire stop, each wire guard having a wing positionable between the respective wire and the respective fastener, a screw mounted in the tongue holding the tongue in engagement with the inwardly extending edges, and a cover mounted on said base, said cover having a pair of opposed support walls, said support walls in engagement with the resilient side walls holding the resilient side walls in place to retain the connector belts in the respective grooves.

13. A connector as defined in claim 1, including: a second cantilever tongue integrally connected to the side walls and being substantially aligned with the first mentioned cantilever tongue, said second cantilever tongue extending in the opposite direction to the first mentioned cantilever tongue, said second cantilever tongue being positioned in contact with a second low voltage track, said second low voltage track having a second insulator body and a pair of spaced conductive wires, said second body having a pair of opposed inwardly extending second edges, said second tongue being positionable between opposed edges of the second low voltage track, said second tongue having opposed portions positionable under the inwardly extending second edges of the second low voltage track, a wire guard mounted in each of the connector belts, each wire guard having a wire stop adjacent to a wire from the first mentioned track and wire from second low voltage track, said wire guard having a pair of wings formed integral with the wire stop, each of said wings positionable adjacent to a respective wire, and a screw mounted in the second mentioned tongue holding the second mentioned tongue in tight engagement with the inwardly extending second edges of the second insulator body.

14. A connector as defined in claim 1, including: a second cantilever tongue integrally connected to the side walls and being substantially aligned with the first mentioned cantilever tongue, said second cantilever tongue extending in a direction opposite to the first mentioned cantilever tongue, said second cantilever tongue being engageable with a second low voltage track, said second low voltage track having a second insulator body and a pair of spaced second conductive wires, said second insulator body having a pair of opposed inwardly extending edges, said second tongue being positioned in contact with the second low voltage track, said second tongue being a portion between the second spaced edges of the low voltage track, said second tongue having opposed portions positionable under the inwardly extending edges of the second insulator body, a wire guard mounted in each of the connector belts, each wire guard having a wire stop, each wire guard having a pair of oppositely extending wings, one of the wings of a wire guard contacting a wire from the first mentioned low voltage track and the other wing contacting a wire from the second low voltage track, and a cover mounted on said base, said cover having a pair of opposed support walls, said support walls in engagement with the resilient side walls for holding the resilient side walls in position.

15. A connector as defined in claim 1, including: a second cantilever tongue integrally connected to the side walls and being substantially aligned with the first mentioned cantilever tongue, said second cantilever tongue extending in a direction opposite to the direction that the first mentioned cantilever tongue extends, said second cantilever tongue being engageable with a second low voltage track, said second low voltage track including a second insulator body having a pair of opposed inwardly extending edges, said second low voltage track including a pair of spaced conductive wires positioned in the second insulator body, a wire from the first mentioned low voltage track and a wire from the second mentioned low voltage track being electrically conductively connected to each other through one of said connector belts, a screw mounted in each of the tongues and being engageable with the respective insulator body holding the tongue in frictional engagement with a pair of opposed inwardly extending edges, and a cover mounted on said base, said cover having a pair of opposed support walls, said support walls in engagement with the resilient side walls to hold the resilient side walls in position.

* * * * *